US005355540A

United States Patent [19]

Allen

[11] Patent Number: 5,355,540

[45] Date of Patent: Oct. 18, 1994

[54] INVALID BED

[76] Inventor: James O. Allen, 1600 Dr. Martin Luther King Dr., Peoria, Ill. 61605

[21] Appl. No.: 135,287

[22] Filed: Oct. 12, 1993

[51] Int. Cl.[5] ..... A61G 7/02

[52] U.S. Cl. ..... 5/604; 5/606; 5/465; 5/900; 5/928; 4/547

[58] Field of Search ..... 5/604–606, 5/463, 465, 900, 928; 4/547, 585

[56] References Cited

U.S. PATENT DOCUMENTS

| | | | |
|---|---|---|---|
| Re. 10,773 | 10/1886 | Johnson . | |
| 608,619 | 8/1898 | McKnight . | |
| 815,481 | 3/1906 | Smith . | |
| 829,481 | 8/1906 | Mitchell | 5/604 |
| 1,054,452 | 2/1913 | Sayen . | |
| 1,070,010 | 8/1913 | Bunnemeyer . | |
| 1,199,886 | 10/1916 | Gill . | |
| 1,295,844 | 3/1919 | Bidwell . | |
| 1,300,364 | 4/1919 | Fitzgerald | 5/604 |
| 1,407,631 | 2/1922 | Brown | 5/604 |
| 1,884,577 | 10/1932 | Comper . | |
| 2,318,240 | 5/1943 | Mas | 5/604 |
| 2,418,259 | 4/1947 | Harmanson . | |
| 3,023,429 | 3/1962 | Chauvac . | |
| 3,373,451 | 3/1968 | Schmidt | 4/585 |
| 3,503,083 | 3/1970 | Barnett . | |
| 3,849,811 | 11/1974 | Cyll . | |
| 3,959,833 | 6/1976 | Burke . | |
| 4,434,517 | 3/1984 | Dorris | 4/585 |
| 4,485,502 | 12/1984 | Marciano | 4/585 |
| 4,620,333 | 11/1986 | Ritter . | |
| 4,631,762 | 12/1986 | Fugett | 5/605 |
| 4,944,058 | 7/1990 | Carnahan et al. . | |
| 5,189,745 | 3/1993 | Workman et al. . | |
| 5,193,232 | 3/1993 | Flood et al. . | |

FOREIGN PATENT DOCUMENTS

| | | | |
|---|---|---|---|
| 1389522 | 4/1975 | United Kingdom | 5/900 |

*Primary Examiner*—Michael F. Trettel
*Attorney, Agent, or Firm*—Polster, Lieder, Woodruff & Lucchesi

[57] ABSTRACT

A bed (10) for patients requiring bed treatment having a cut out (19) in the base (18) beneath which is a toilet pan (22, 23, 25) preferably having flowing water supply (26) and drain (27) connections. A mattress (35) having one quarter (36) removed is positioned on the base (18) with the open quadrant (36) over the pan (22). A movable mattress segment (40) is positioned on the base (18) in the open quadrant (36) of the mattress (35) and is vertically adjustable to align with the mattress top and laterally movable to expose the pan (22) and allow patients to relieve themselves without having to be moved to insert conventional bed pans. The toilet pan (22) is cleaned using the water supply which is controlled by movement of the movable segment (40). An alternative embodiment has an attachable hot and cold water supply (58) with a wash basin (53) to allow patients to wash themselves. Still another embodiment has a frame (66) and a water impervious cover (70) which, when positioned on the mattress (35), allows patients to bath themselves.

12 Claims, 4 Drawing Sheets

INVALID BED

BACKGROUND OF THE INVENTION

This invention relates to a bed construction for use by the bed ridden or semi-invalid and is designed to eliminate the use of conventional bed pans and also allow patients, if they are able, to wash themselves and even take a bath in the bed itself.

It is a principal object of this invention to provide a bed which can be adjusted to allow the patient to use the toilet without having to move the patient to insert a conventional bed pan. It is a further object to provide a toilet associated with a bed mechanism which can be flushed without manual removal of the receptacle.

It is another object of this invention to provide a mattress with a movable section to provide a V-shaped opening beneath the patient to allow the patient to relieve him or herself and at the same time automatically energize a source of water to flush and cleanse the receptacle beneath the V-shaped opening.

It is still another object of this invention to provide a bed and an attachable wash basin with hot and cold running water to allow patients to wash themselves.

Still another object is to provide an auxiliary frame for a bed which frame has a water impervious cover of rubber or the like and which defines a tub on the bed to allow patients to bath themselves from a source of hot and cold running water attached to the bed.

These and other objects and advantages will become apparent hereinafter.

DESCRIPTION OF THE DRAWINGS

In the accompanying drawings wherein like numerals ref to like parts wherver they occur.

SUMMARY OF THE INVENTION

This invention comprises a bed for patients requiring bed treatment and has a V-shaped cut out in the base beneath which is a toilet pan preferably having flowing water supply and drain connections. A mattress having one quarter removed is positioned on the base with the open quadrant over the pan. A movable mattress segment is positioned on the base in the open quadrant of the mattress and is vertically adjustable to align with the mattress top and movable to expose the pan and allow patients to relieve themselves without having to be moved to insert conventional bed pans. The toilet pan is cleaned using the water supply which is controlled by movement of the movable segment. An alternative embodiment has an attachable hot and cold water supply with a wash basin to allow patients to wash themselves. Still another embodiment has a frame with a water impervious cover which, when positioned on the mattress, allows patients to bath themselves.

DETAILED DESCRIPTION

Figure 1:
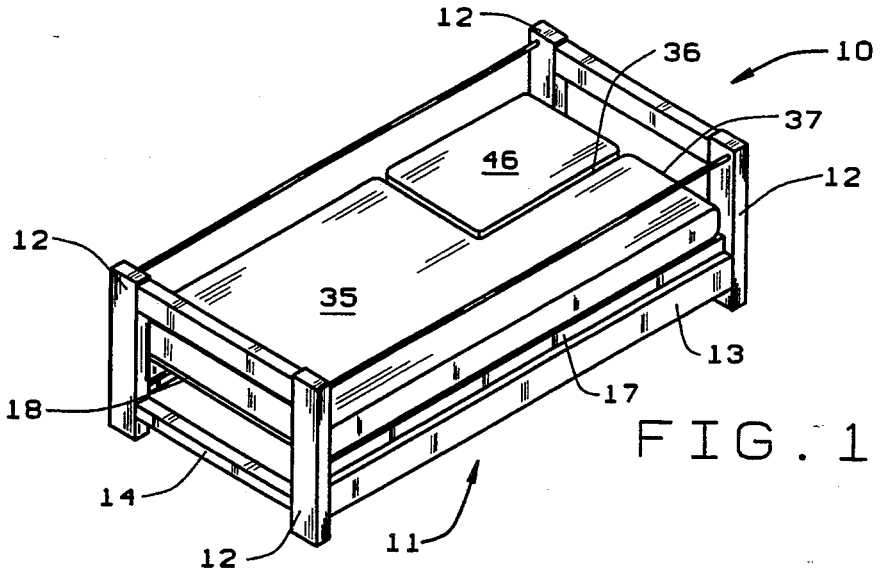
FIG. 1 is a perspective view of the invention.
Figure 2:
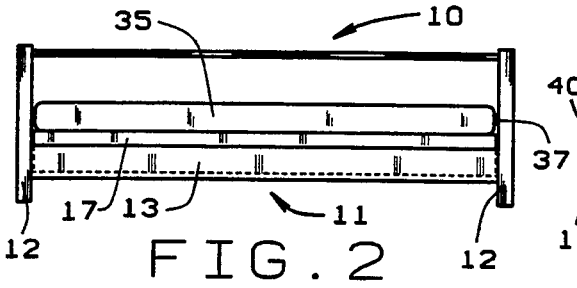
FIG. 2 is a right side elevational view.
Figure 3:
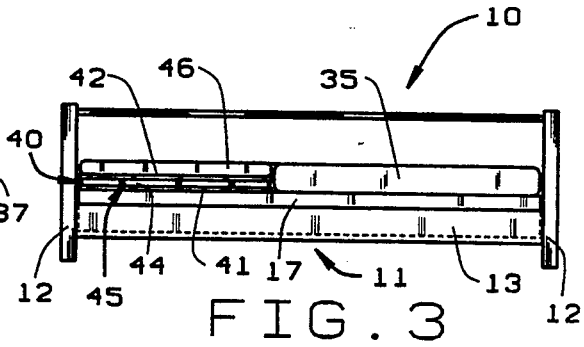
FIG. 3 is a left side elevational view.
Figure 4:
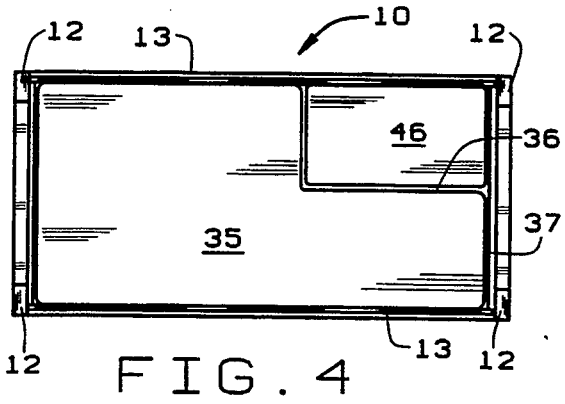
FIG. 4 is a top plan view.
Figure 6:
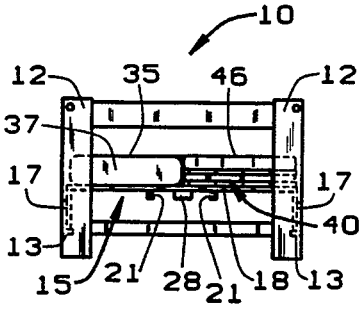
FIG. 6 is a head end detail view.
Figure 8:
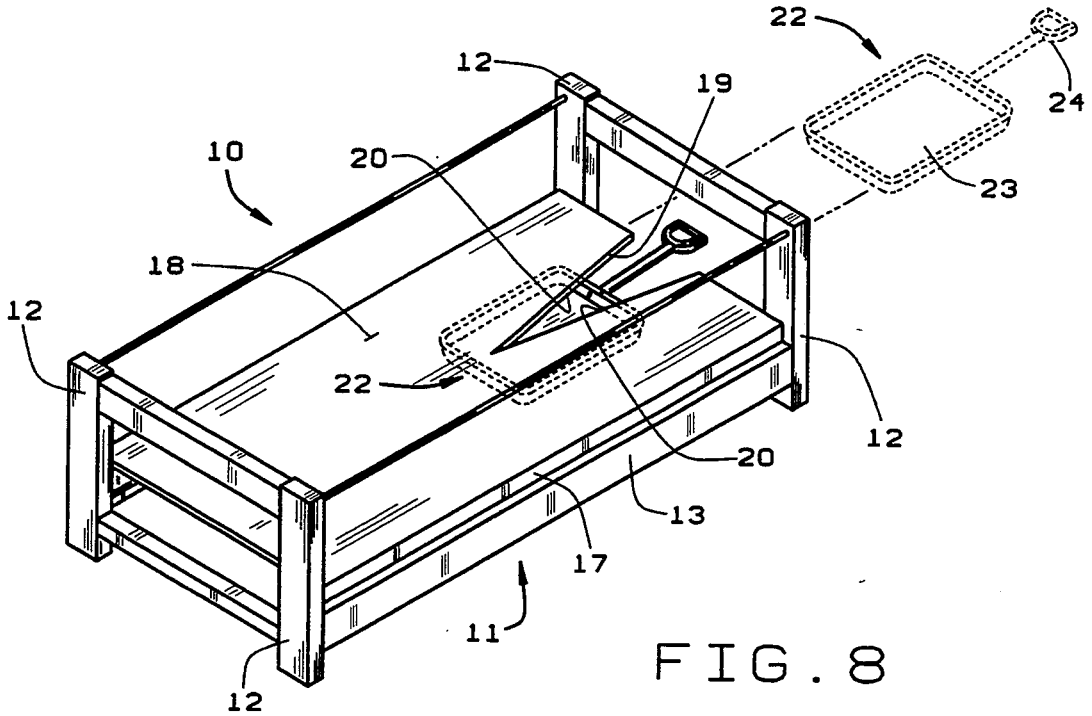
FIG. 8 is a perspective view of another form of, the invention which shows the V.
Figure 9:
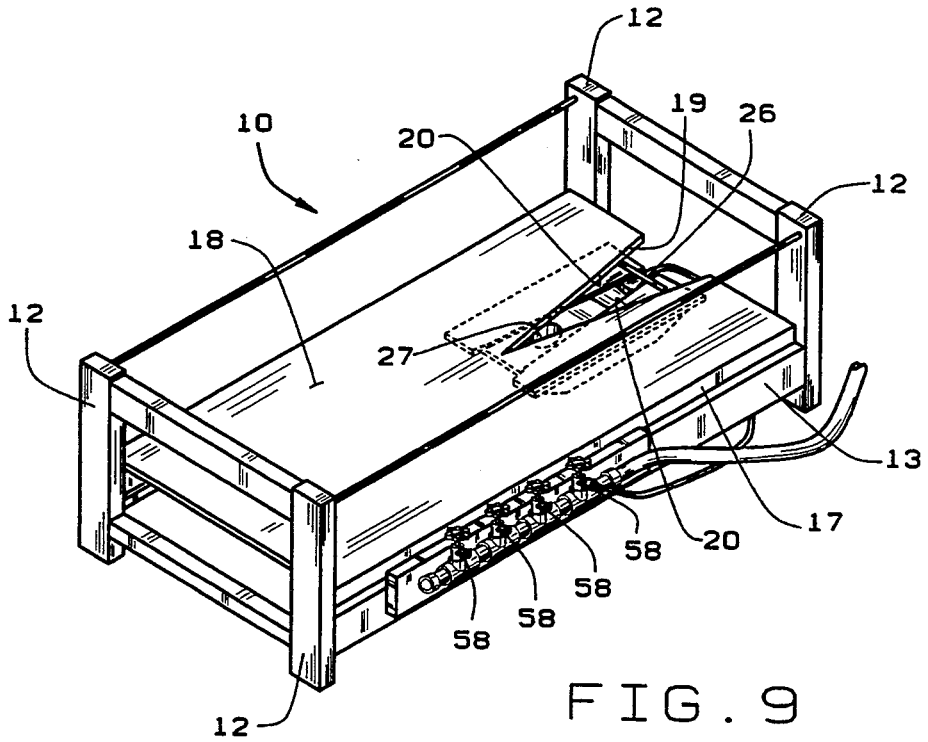
FIG. 9 is a perspective view of still another form of the invention which shows the V.

FIG. 1 shows the present invention embodied in an invalid bed 10 having a frame 11 comprising upright end posts 12 connected by side frame members 13 and end frame members 14. The side frame members 13 have opposed interior side rails 15 (shown in FIG. 6). The side rails 15 support a box base 16 which has side supports 17 and a top member 18. The top member 18 has a V-shaped cut out 19 in the head end. The V-shaped cut out 19 extends into the top member 18 a sufficient distance to encompass the buttocks of a patient lying prone on the bed 10. This structure also is shown in FIGS. 8 and 9.

Positioned beneath the top member 18 along the side edges 20 of the cut out 19 are tracks 21 which retain various forms of waste receptacle pan 22. The receptacles 22 can take the form of a simple pan 23 with a handle 24 for easy insertion and removal as shown in FIG. 8, or a fixed drain tray 25 having flush water connections 26 and a drain water connection 27 as shown in FIG. 9. If the removable drain pan 23 is used, a stop 28 is placed at the ends of the tracks 21 on the base 16.

Positioned on the box top surface 29 is a mattress 35 which is of conventional construction, but has one quadrant 36 removed. This quadrant 36 or corner quarter section, is at the mattress head end 37 and, when the mattress 35 is placed on the box top 18, exposes a portion of the V-shaped opening 19.

Figure 7:
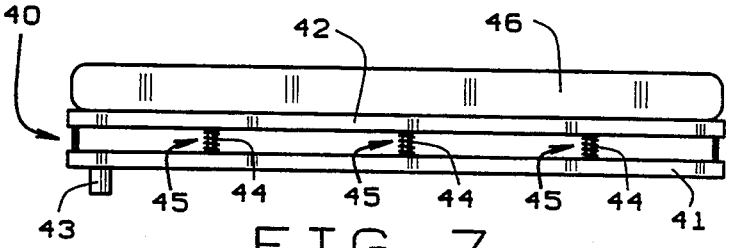
FIG. 7 is a side elevational view of the movable section.

Positioned in the missing mattress quadrant 36 is a pivotable auxiliary mattress support section 40 which is shown in FIG. 7 and comprises spaced longitudinal members 41 and 42. The lower member 41 is adapted to slide across the box top surface 18 and is pivotally connected to the box 16 by a pivot 43. The top member 42 and the bottom member 41 are spaced by pins 44 which are surrounded by coil springs 45. The pins 43 are threaded at one end and allow the top member 42 to be adjusted vertically with respect to the bottom member 41 to compensate for different size mattresses 35. A pad 46 is positioned on and attached to the pivotable section 40 so that it moves with the section 40.

Figure 5:
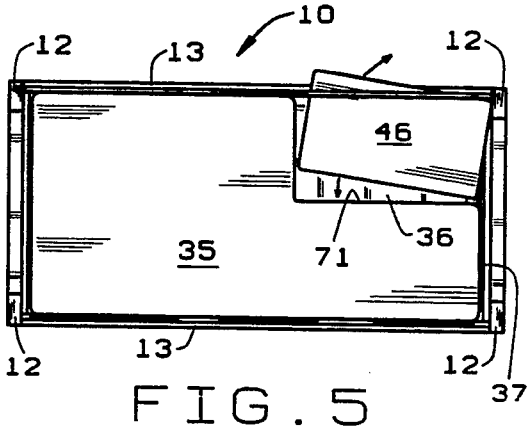
FIG. 5 is a top plan view with the movable section in open position which is a V.

The auxiliary section 40 is pivoted outwardly to expose the V-shaped cut out 19 when the user of the bed 10 needs to go to the toilet. The pivoting opening of the auxiliary section 40 (FIG. 5) allows the patient to use the toilet without having to be moved to insert and remove a bed pan and without the inconvenience and discomfort associated with the raised bed pan.

If a fixed drain pan 26 is used, it is desirable to have the water automatically start to flow into the pan 26 and out of the drain 17 as soon as the auxiliary section 40 is opened. When it is closed, the flow of water is cut off. A conventional water cut off valve or an electrically controlled switch operated by movement of the section 90 can be used.

The auxiliary section 40 can be opened manually, mechanically by a screw drive, or by an electrical motor activated by a switch accessible to the patient.

Figure 10:
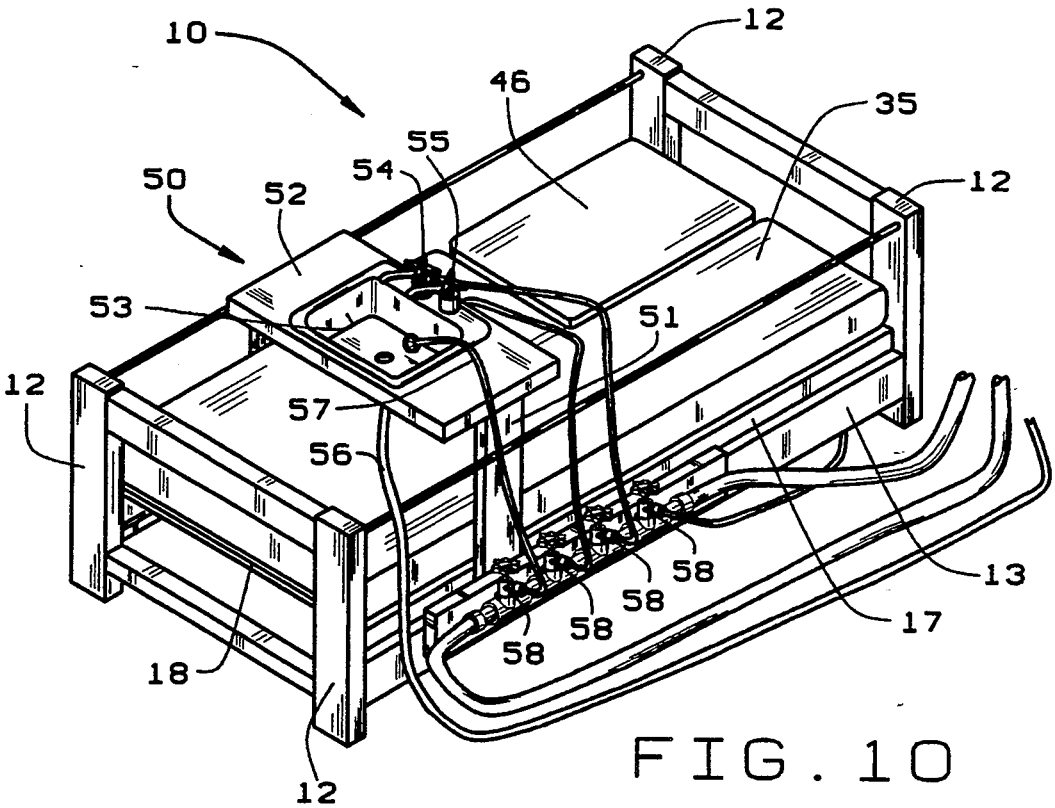
FIG. 10 is a perspective view of still another form of the invention.
Figure 11:
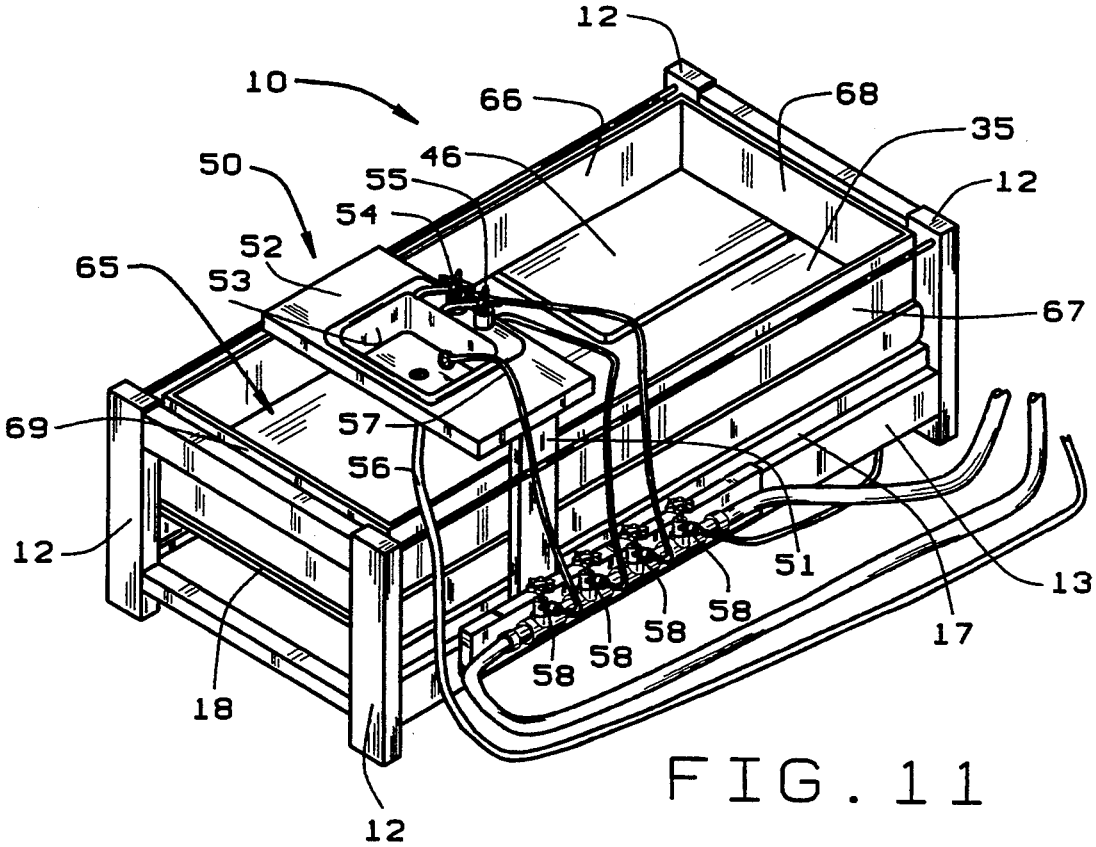
FIG. 11 is a perspective view of still another form of the invention.
Figure 12:
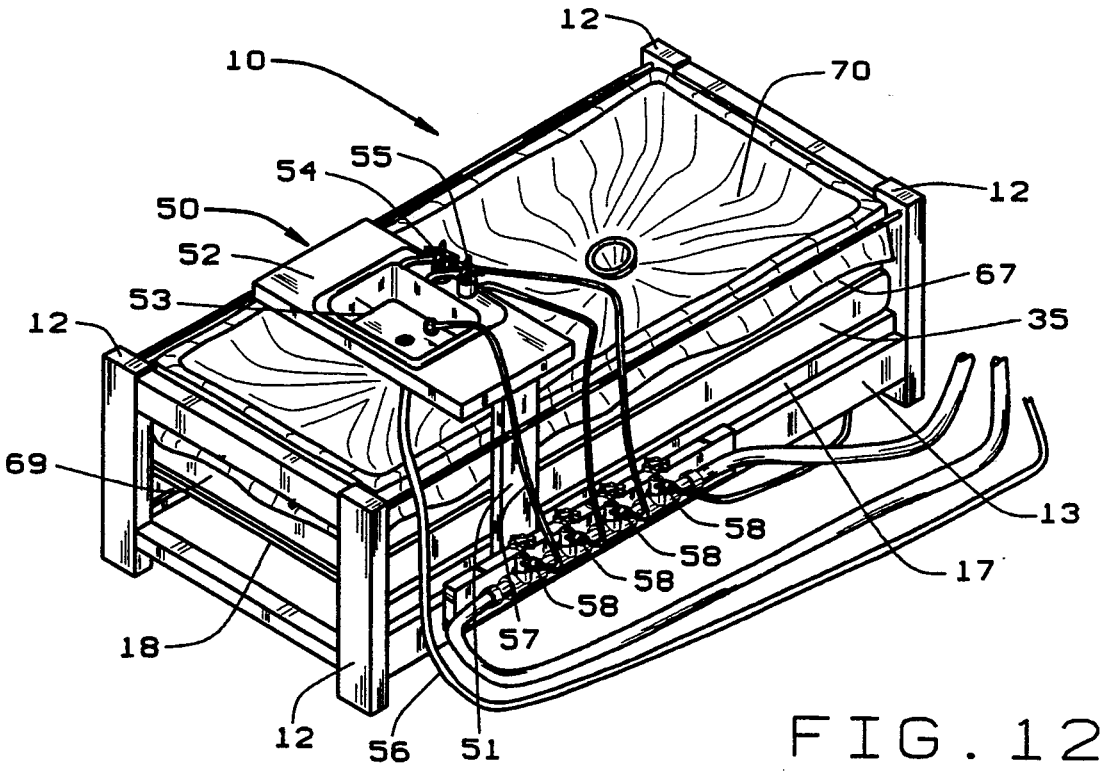
FIG. 12 is a perspective view of still another form of the invention.

Another aspect of the invention is the provision of a detachable wash basin assembly 50 on the bed frame side members 13. This construction is shown in FIGS. 10–12 and consists of upright side supports 51 which are removably attached to the side frames 13 by any suitable fastening means. A horizontal counter 52 connects the side supports 51 and is provided with a basin 53, hot and cold water faucets 54 and 55, a drain 56, and a water spray nozzle 57. This arrangement allows the patients to sit up and wash themselves or allows family members or nurses to easily wash the patient. A water supply manifold 58 is permanently attached to the bed side frame 13.

A further aspect of the invention is shown in FIGS. 11 and 12. This comprises a box structure 65 having side walls 66 and 67 and end walls 68 and 69. The box 65 has an open top and open bottom which allows it to be placed on the bed 10 without removing the patient from the bed. This form of the invention allows patients to bath themselves or to be bathed by family members or nurses. The box 65 is used in conjunction with a water impervious cover 70 having a drain 71 which connects to the pan 22 beneath the bed 10 through the V-shaped opening 71 (FIG. 5) formed by partially opening the auxiliary section 40.

This form of the invention also uses the wash basin support 50 as a source of water and uses the hose and nozzle 57 for washing. If desired, the wash basin support 50 need not be used, and only a source of running hot and cold water is used, preferably in a mixer nozzle.

This invention is intended to cover all changes and modifications of the example of the invention herein chosen for purposes of the disclosure which do not constitute departures from the spirit and scope of the invention.

What is claimed is:

1. An invalid bed comprising (a) a frame, (b) a bottom support positioned on the frame having a top mattress supporting surface with a V-shaped opening beneath the buttocks of the patient, (c) a waste receptacle pan beneath the opening, (d) a mattress positioned on the supporting surface, said mattress having a cut out area beneath the buttocks of the user aligned with the top surface opening, and (e) an auxiliary mattress segment movable into and away from the cut out area to expose the top surface opening for toilet use by the patient without moving the patient.

2. The bed of claim 1 including runways on the underside of the mattress supporting surface to accommodate the waste receptacle and provide for its sliding movement into and out of alignment with the opening in the top surface.

3. The bed of claim 2 including a stop at the ends of the runways to locate the pan with respect to the opening.

4. The bed of claim 1 including a flush water source and a drain on the pan to flush patient waste material from the pan.

5. The bed of claim 1 wherein the mattress cut out area is one quadrant of the mattress.

6. The bed of claim 1 wherein the auxiliary mattress section is pivotally connected to the bed and opens to a V-shaped opening beneath the buttocks of the patient.

7. The bed of claim 6 wherein the auxiliary mattress section has spaced apart top and bottom members, pins connecting the top and bottom members, coil springs surrounding the pins to urge the members apart, and means associated with the pins to adjust the spacing between the top and bottom members.

8. The bed of claim 1 including a wash basin and support structure attachable to the frame and bridging the bed, and hot and cold running water conduit attached to faucets on the basin, and a drain conduit attached to the basin.

9. The bed of claim 1 including a bath defining structure for insertion over the patient on the bed, said bath structure comprising a frame which fits over the patient and rests on the bed, a water impervious membrane positionable in the frame beneath the patient to define a bed, drain conduit connected to the membrane, and hot and cold running water sources for the patient to allow the patient to bath without leaving the bed.

10. An invalid bed comprising (a) a frame, (b) a bottom support positioned on the frame having a top mattress supporting surface with a V-shaped opening beneath the buttocks of the patient, (c) a waste receptacle pan positioned beneath the opening, flush water source for the pan and a drain on the pan to flush patient waste material from the pan, (d) a mattress positioned on the supporting surface, said mattress having a cut out area beneath the buttocks of the user aligned with the top surface opening, the mattress cut out area being one quadrant of the mattress, (e) an auxiliary mattress segment pivotally connected to the bed and movable into and away from the mattress cut out area to expose the V-shaped top surface opening for toilet use by the patient without moving the patient, the auxiliary mattress section having spaced apart top and bottom members, pins connecting the top and bottom members, coil springs surrounding the pins to urge the members apart, and means associated with the pins to adjust the spacing between the top and bottom members, (f) a wash basin and support structure attachable to the frame and bridging the bed, and hot and cold running water conduits attached to faucets on the basin, and a drain conduit attached to the basin, and (g) a bath defining structure for insertion over the patient on the bed, said bath structure comprising a frame which fits over the patient and rests on the bed, a water impervious membrane positionable in the frame beneath the patient to define a bed, drain conduit connected to the membrane, and hot and cold running water sources for the patient to allow the patient to bath without leaving the bed.

11. An invalid bed comprising (a) a frame, (b) a bottom support positioned on the frame having a top mattress supporting surface with an opening beneath the buttocks of the patient, (c) a waste receptacle pan beneath the opening, (d) a mattress positioned on the supporting surface, said mattress having a cut out area beneath the buttocks of the user aligned with the top surface opening, and (e) an auxiliary mattress segment movable into and away from the cut out area to expose the top surface opening for toilet use by the patient without moving the patient, the auxiliary mattress segment being pivotally connected to the bed and opening to a V-shaped opening beneath the buttocks of the patent.

12. The invalid bed of claim 11 wherein the auxiliary mattress segment has spaced apart top and bottom members, and means for adjusting the vertical distance between the top and bottom members.

* * * * *